US005824263A

United States Patent [19]

Erny et al.

[11] Patent Number: 5,824,263

[45] Date of Patent: Oct. 20, 1998

[54] LADLE BRICK LEVELING SET

[75] Inventors: Edward L. Erny, Bethel Park, Pa.; William J. Winters, Hudson, Ohio

[73] Assignee: Harbison-Walker Refractories Company, Dallas, Tex.

[21] Appl. No.: 589,709

[22] Filed: Jan. 22, 1996

[51] Int. Cl.[6] ..... C21B 7/04

[52] U.S. Cl. ..... 266/283; 266/280; 52/249

[58] Field of Search ..... 266/275, 280, 266/283, 285, 286, 200; 52/249, 604, 612; 432/262, 264, 265

[56] References Cited

U.S. PATENT DOCUMENTS

| | | | |
|---|---|---|---|
| 229,724 | 7/1880 | Mann et al. | 52/249 |
| 2,526,289 | 10/1950 | Smith | 52/249 |
| 3,972,516 | 8/1976 | Napora | 266/283 |

FOREIGN PATENT DOCUMENTS

| | | | |
|---|---|---|---|
| 1188073 | 6/1985 | Canada | 266/283 |

OTHER PUBLICATIONS

Shamva catalog, Catalog No. 102, H.K. Porter Co., Inc. Class 266/283 Jan . 1958.

*Primary Examiner*—Scott Kastler
*Attorney, Agent, or Firm*—Craig G. Cochenour

[57] ABSTRACT

A ladle brick leveling set for high temperature molten metal ladles in which specially shaped refractory bricks are disposed in a slightly sloping geometrical configuration so as to compensate for a sloping bottom of a high temperature molten metal ladle. The bricks are disposed in two partial rings each of which is essentially a mirror image of the other so that the height of the leveling set varies substantially uniformly from a high point where the two mirror image portions join to a low point 180 degrees of arc displaced therefrom where the two portions again join. Each of the refractory bricks has a slight taper in height so that the ends of each brick are the same height as the juxtaposed ends of the adjoining bricks.

17 Claims, 4 Drawing Sheets

LADLE BRICK LEVELING SET

This invention relates to high temperature refractories and more particularly to courses of refractories providing for leveling of refractories in vessels with sloping bottoms.

BACKGROUND OF THE INVENTION

As will be recognized by those skilled in the art, in high temperature vessels such as molten steel ladles, one problem heretofore encountered relates to preventing slag from contaminating or otherwise being mixed with the relatively pure steel when it is being withdrawn from the vessel. Since slag is less dense than the molten steel, the slag tends to rise and accumulate on top of the underlying steel. If a pouring orifice is provided in the bottom of the vessel, relatively uncontaminated molten steel can be withdrawn simply by opening the orifice to permit the liquid steel to exit therethrough. However, when the liquid surface falls until it is near the bottom of the vessel, pouring must stop before slag exits along with the remaining steel; and thus a small quantity of steel remains in the vessel and is unusable. In order to keep this quantity as small as practicable, it has become customary to provide sloping bottoms with a low point at or near the edge of the vessel where a pouring orifice is positioned. However, this has brought about a relative inefficiency in refractory brick utilization.

The harsh and erosive properties of slag are well known; and in order to protect walls of a vessel in the vicinity of slag locations a refractory brick that is more slag-resistant (and more expensive) than refractory bricks for contact with molten steel has been required. Thus, less expensive refractory bricks that are acceptable for use in contact with molten steel do not adequately withstand the rigors of on-going contact with slag. Accordingly, it has been customary to line the interior of a vessel designed for use with molten steel (e.g., a ladle) with lesser cost refractory bricks in regions encountering just liquid steel, while installing the more costly bricks only in regions expected to normally encounter slag. Since slag normally resides on the surface of the molten steel, such more costly bricks are used to line just the upper region of the interior which usually is adjacent the mouth of the vessel.

For simplicity and cost effectiveness, it is customary to line the interior of a high temperature vessel with refractory bricks beginning at the bottom; and, after installing bricks overlying the bottom, to work upward to cover the interior walls with successive courses until the entire interior has been covered. It will thus be observed that if the bottom slopes, the successive rings of side wall bricks will also slope, forming rings that are tilted to follow the slope of the bottom. However, the surface of the liquid contents of the vessel will be horizontal, generally parallel to the plane containing the earth's natural surface at that location; and so the plane containing the liquid surface will lie at an angle to the planes of the successive rings of refractories. Accordingly, in order to ensure that normal contact between slag and refractories is in a region of the lining in which the more expensive bricks are installed, it has been necessary to provide several extra courses of such more expensive bricks.

The use of refractory castables or ramming mixes to compensate for the slope is generally unsatisfactory. Monolithic materials, field applied, never develop the desirable combination of physical and chemical properties typical of a fired brick. Cast or rammed fillers or ramps require extended and, hence, costly installation time.

BRIEF SUMMARY OF THE INVENTION

The improvement according to the invention hereof includes the provision of one or more courses of bricks of coordinated and tapered heights to form correspondingly tapered compensating courses. In vessels of essentially circular or oval geometry, this results in the provision of an essentially circular ring which from a high point (where the bricks of the ring are the highest, tapers to a low point 180 degrees displaced therefrom where the bricks of the ring are the lowest. Thus, the taper of the ring or rings compensates for the sloping bottom so that additional courses of bricks that are installed above the compensating courses lie in planes generally parallel to the surfaces of both liquid metal and slag; and since the aforementioned relative angle therebetween is; eliminated, only one course (or minimum number of courses) of the more expensive slag-resistant bricks are required to encompass expected slag contact regions, thus saving cost.

OBJECTS AND FEATURES OF THE INVENTION

It is one general object of the invention to improve high temperature refractory linings in liquid steel handling vessels.

It is another object of the invention to facilitate use of such vessels in which the bottoms are sloped.

It is another object of the invention to reduce maintenance costs for high temperature linings for refractory-lined vessels with sloping bottoms.

It is yet another object of the invention to reduce damage and down time for high temperature refractories resulting from slag attack.

Accordingly, in accordance with one feature of the invention, pluralities of individual refractory bricks are assembled to form courses having heights that are tapered to compensate for the slope angles of sloping bottoms, thus providing support for succeeding courses of refractories that are generally parallel to expected layers of erosive materials such as slag.

In accordance with another feature of the invention, the compensating course (or courses) may be positioned adjacent the sloping bottom of the vessel or part of the way up the sides, thus providing flexibility in installation.

In accordance with another feature of the invention, the aforementioned course arrangements may be installed in annular rings each of which, for circular vessels, may be configured in two 180 degree semicircles which are mirror images of each other, thus enhancing simplicity of installation.

These and other objects and features of the invention will be apparent from the following description, by way of example of a preferred embodiment, with reference to the drawing.

DESCRIPTION OF A PREFERRED EMBODIMENT

Figure 1:
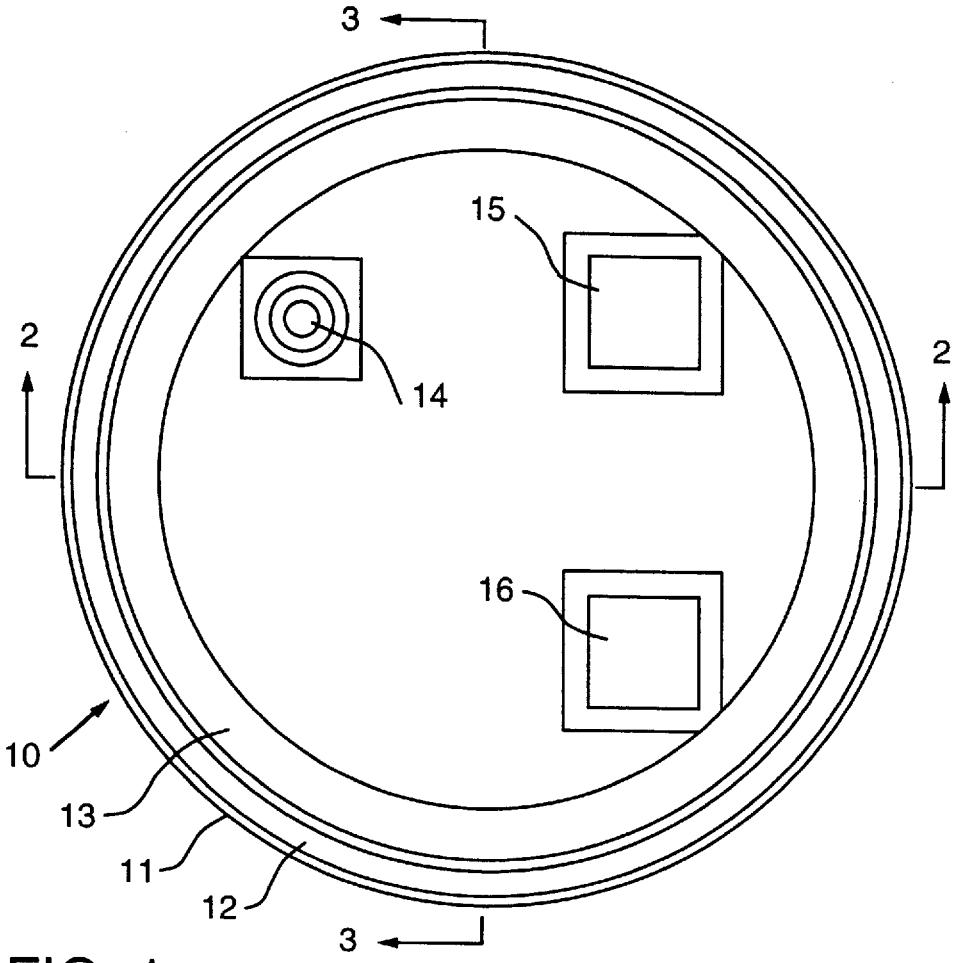
FIG. 1 is a top view of a typical refractory-lined vessel used for handling molten steel.

Now turning to the drawing, and more particularly FIG. 1 thereof, it will be seen to depict a typical circular vessel or ladle 10 employed in the steel-making industry for handling molten steel. The vessel typically includes an outer steel shell 11, a first lining of refractory bricks 12, and an interior lining of refractory bricks 13. Included within the interior bottom are conventional tap hole 14, and injector locations 15 and 16. Injectors are not necessarily employed in all ladles, and the tap hole is preferably located at the lowest point of the sloped bottom. The offset shown in FIG. 1 is to accommodate other equipment.

Figure 2:
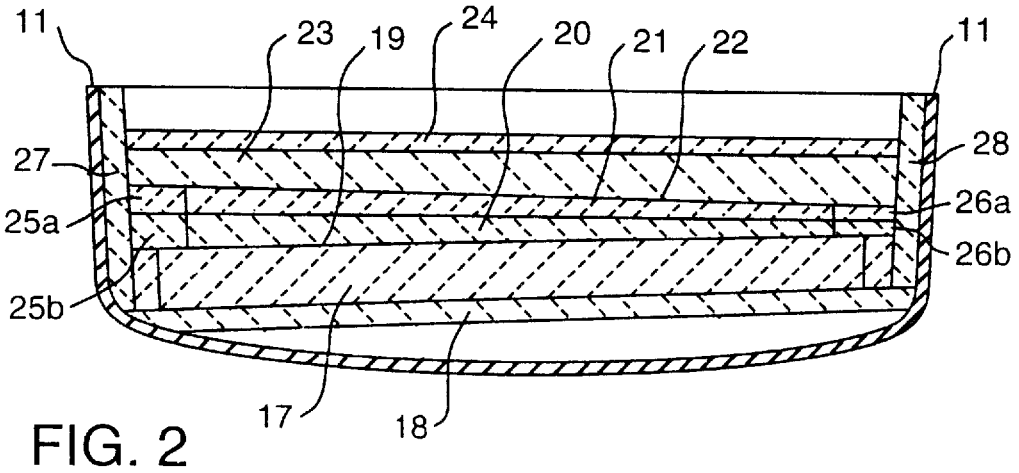
FIG. 2 is a partial sectional view taken along the section lines 2—2 of FIG. 1.
Figure 3:
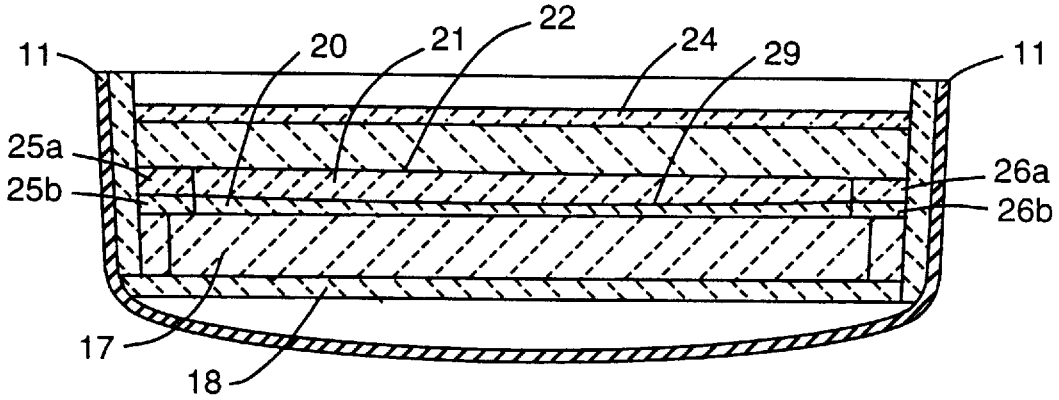
FIG. 3 is a partial sectional view taken along the section lines 3—3 of FIG. 1.

To further illustrate the interior of FIG. 1 and to depict the leveling courses of refractories constructed according to the invention, sections 2—2 and 3—3 are shown respectively in FIGS. 2 and 3. In FIG. 2, there are seen two layers 17 and 18 of refractories that typically line the bottoms of high temperature liquid steel handling vessels. It will be observed that these two layers are each generally of uniform thickness and are installed to present a sloping upper surface 19 which slopes down toward tap hole 14 so as to facilitate draining of molten steel from the vessel. As mentioned above, such sloping surface provides advantages. However, in order to provide the aforementioned levelling, a pair of tapered layers 20 and 21 are installed so that the upper surface 22 of layer 21 is essentially level (as shown). Accordingly, successive courses of bricks as represented by courses 23 and 24 are essentially parallel to the plane containing the mouth (not shown) of the vessel 10 so that the course of the more slag-resistant (and expensive) refractories described above need be of minimum height. If the dimensions of the ladle are such that the ends of the tapered layers 20 and 21 are not adjoining, they can be made to "communicate", i.e., form a ring with the use of transition refractories. At both ends of tapered layers 20 and 21 there are shown transition refractories 25*a*/25*b* and 26*a*/26*b* which connect with the layers and abut conventional side wall refractories 27 and 28. Refractories 25*a*/25*b* and 26*a*/26*b* are splits or soaps which are not tapered and are of the same thickness (height) of the adjacent brick in the ring.

FIG. 3 is seen to depict the geometrical relationship of the foregoing courses of refractories at an angle of 90 degrees to that of FIG. 2; and like parts are, of course, identified with like symbols. There, the levelling courses 20 and 21 are are shown, with surface 22 of layer 21 being essentially level, and with the line 29 between layers 20 and 21 reflecting the tapering and curved nature of the interior of the vessel.

Figure 5:
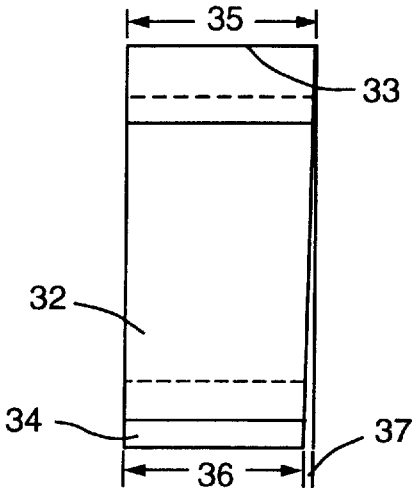
FIG. 5 is a side view of the special brick of FIG. 4.
Figure 4:
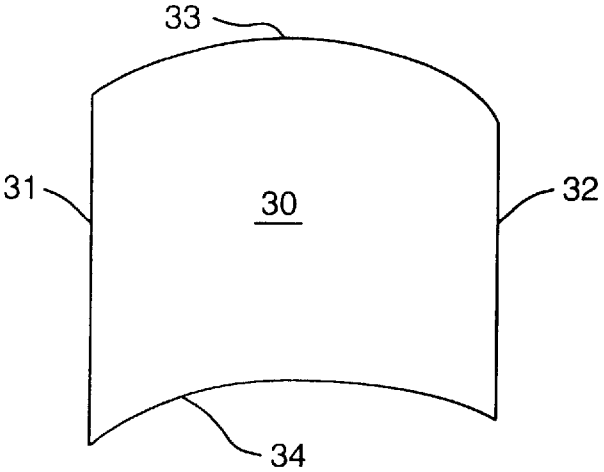
FIG. 4 is top view of a special brick preferred for practicing the invention.
Figure 6:
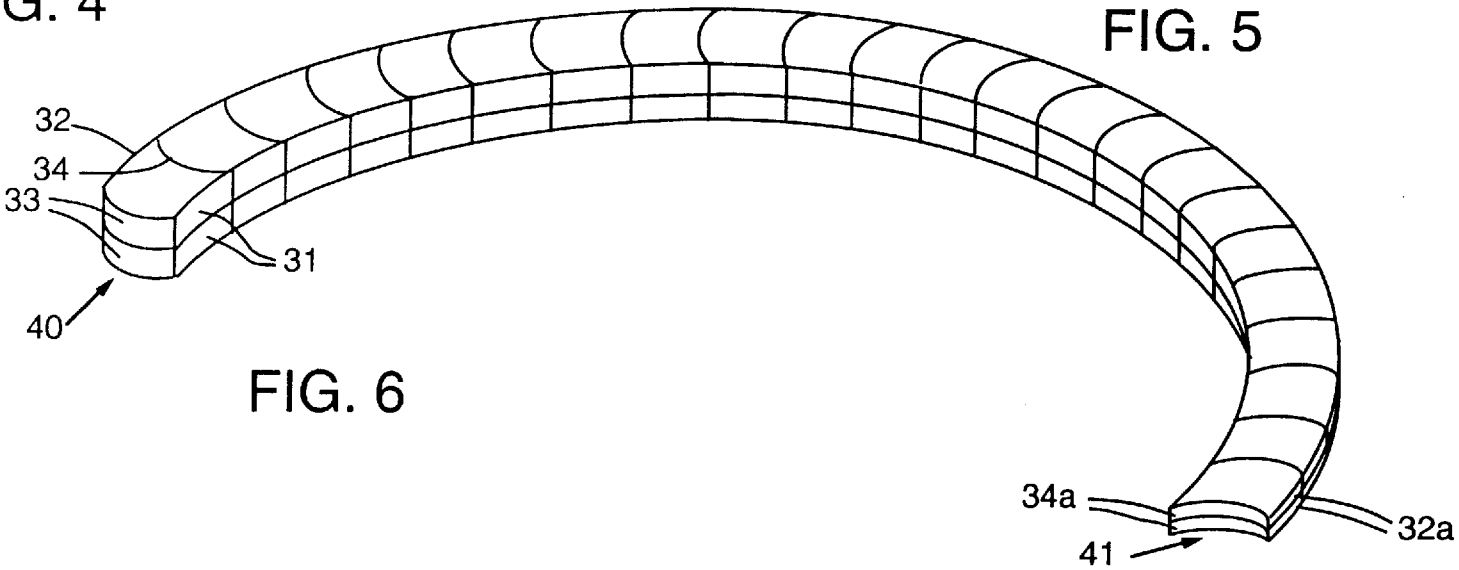
FIG. 6 is a perspective view illustrating one of two semicircular half rings of refractory bricks configured according to the invention.

Now turning to FIGS. 4 and 5, a refractory brick according to the invention hereof is depicted. FIG. 4 is a top view of a particular semi-universal brick 30, that along with a universal brick is preferred for practicing the invention. Also suitable are key, circle, wedge brick, and the like. There, it will be observed that brick 30 includes a pair of substantially parallel surfaces 31 and 32, together with a pair of curved surfaces 33 and 34 which are complementary and provide for form fitting of adjacent bricks as is shown in FIG. 6.

As mentioned above, FIG. 5 is a side view of the special brick of FIG. 4 and illustrates the gradual tapering feature that results in compensation as previously described. Thus, the height of the brick at end 33 as measured by dimension 35 is greater than the height of the brick at end 34 as measured by dimension 36; and the difference, as represented by dimension 37, results in a controlled taper in brick height which is progressive as shown in FIG. 6. Thus, height of each brick in the representative half circle ring of FIG. 6 is different from each adjacent brick so as to result in a smooth taper from left end 40 to right end 41 as shown. Also, it should be observed that at right end 41, the much less high (shorter) refractories are shown and their relevant surfaces are identified by numerals 32*a* and 34*a*.

It will be evident that in order for compensation (as described above) to occur, the amount of taper is determined by the degree to which the bottom refractories 17 of the vessel 10 slope as evidenced by the slope of surface 19 (FIG. 2). Therefore, the amount of taper from left end 40 to right end 41 will vary depending upon the taper of the bottom slope of the vessel.

As mentioned above, FIG. 6 is a perspective view illustrating one of two semicircular half rings of refractory bricks configured according to the invention, the complementary semicircular half ring being a mirror image of the half ring shown. In FIG. 6 it will be observed, there are two essentially identical courses of refractories, one overlying the other. To complete a full ring, the mirror image courses are adjoined at ends 40 and 41 to complete a circular installation as depicted in FIGS. 1–3.

To join two half rings, "left" and "right" hand tapered brick would be required. To avoid additional mold costs, a more practical approach is to cut the ends of both courses of both rings so that they mate at a plane vertical surface.

Figure 7:
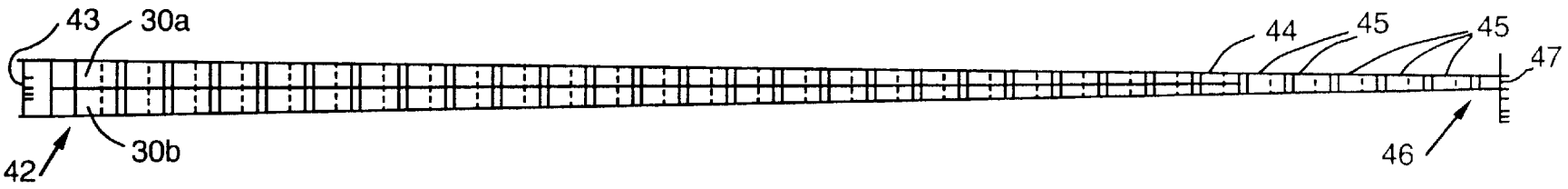
FIGS. 7 and 8 are linear views (elevation and plan respectively) depicting a modification of FIG. 6 in which two courses of bricks overlie one another for the principal part of the semicircle, while the thinner end is comprised of a single layer only.

FIG. 7 is a side view depicting a modification of FIG. 6 in which two courses of bricks overlie one another for the principal part of the semicircle, while the thinner end is comprised of a single layer only. Thus at left end 42 the overlying nature of the courses is represented by overlying refractories 30*a* and 30*b* which in one illustrative embodiment result in a total course height at end 42 of 8.5 inches as shown by dimension 43. In this embodiment, the dual geometry of the courses continues to point 44 at which the total height has declined such that the remainder includes just one brick 45. In the illustration hereof, the height at end 46 has decreased to 1.25 inches as shown by dimension 47.

Figure 8:
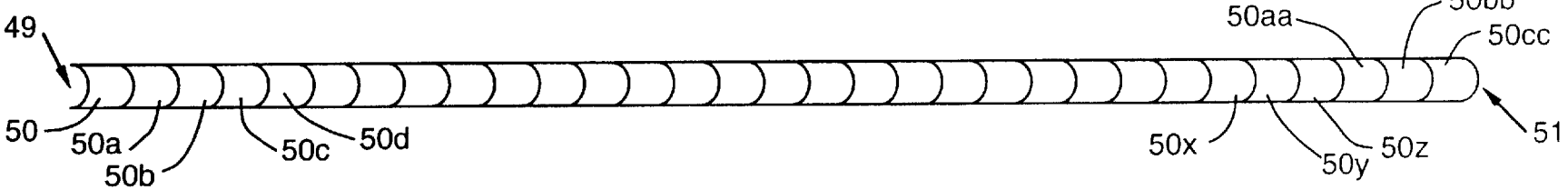

As mentioned above, the principles of the invention may have applicability to non-circular vessels; and to illustrate such, there is included the array shown in FIG. 8. There, in FIG. 8 is depicted a top view illustrating tapered refractories of the general type shown in FIG. 4. Beginning at the left end 49 of the array are courses 50–50*d* which continue to right end 51 which concludes with course 50*cc*. As with the configurations previously described, the degree of taper provided by refractories 50–50*cc* is complementary to the corresponding slope of the lower surface of the vessel in which they are to be installed so as to provide levelling compensation. Thus the principle can be applied to linings comprising both curved and plane surfaces.

It will now be evident that there have been described herein improved leveling assemblies and refractory bricks for use therein.

Although the inventions hereof have been described by way of a preferred embodiment, it will be evident that other adaptations and modifications may be employed without departing from the spirit and scope thereof.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. An interconnected refractory brick leveling assembly for a high temperature molten metal ladle having a sloping bottom, comprising a first plurality of high temperature refractory bricks assembled into a first partial ring and a second plurality of high temperature refractory bricks assembled into a second partial ring, all of said bricks having dimensions of height, width and length, each brick of each partial ring having a sloping height and a median dimension of height different from each adjacent brick in said each partial ring, and wherein each said partial ring is a semicircle.

2. An interconnected refractory brick leveling assembly for a high temperature molten metal ladle having a sloping bottom, comprising a first plurality of high temperature refractory bricks assembled into a first partial ring and a second plurality of high temperature refractory bricks assembled into a second partial ring, all of said bricks having dimensions of height, width and length, each brick of each partial ring having a sloping height and a median dimension of height different from each adjacent brick in said each partial ring, in which said first partial ring is a first semicircle and said second partial ring is a second semicircle, in which said semicircles each have a first end and a second end, and in which said first end of said first semicircle is in communication with said first end of said second semicircle and said second end of said first semicircle is in communication with said second end of said second semicircle to form one complete circle.

3. An interconnected refractory brick leveling assembly for a high temperature molten metal ladle having a sloping bottom, comprising a first plurality of high temperature refractory bricks assembled into a first partial ring and a second plurality of high temperature refractory bricks assembled into a second partial ring, all of said bricks having dimensions of height, width and length, each brick of each partial ring having a sloping height and a median dimension of height different from each adjacent brick in said each partial ring and in which said first partial ring is a first semicircle and said second partial ring is a second semicircle, in which said semicircles each have a first end and a second end, and in which said first end of said first semicircle is in communication with said first end of said second semicircle and said second end of said first semicircle is in communication with said second end of said second semicircle to form one complete circle, and in which said heights of adjoining ends of brick at adjoining ends of said first and said second semicircles are essentially identical.

4. An interconnected refractory brick leveling assembly for a high temperature molten metal ladle having a sloping bottom, comprising a first plurality of high temperature refractory bricks assembled into a first partial ring and a second plurality of high temperature refractory bricks assembled into a second partial ring, all of said bricks having dimensions of height, width and length, each brick of each partial ring having a sloping height and a median dimension of height different from each adjacent brick in said each partial ring, further including at least one additional level of leveling refractory bricks overlying said first partial ring and said second partial ring to further compensate for said sloping bottom.

5. An interconnected refractory brick leveling assembly according to claim 4 in which two courses of brick overlie one another for the principal part of a semicircle and for the remainder of said semicircle there is only a single layer.

6. A vessel for containing high temperature molten metal, said vessel having a supporting shell with side walls and a sloping bottom to form an interior for containing said molten metal, said interior of said vessel including a lining of refractory bricks, an interconnected refractory brick leveling assembly comprising a first plurality of high temperature refractory bricks assembled into a first partial ring and a second plurality of high temperature refractory bricks assembled into a second partial ring, all of said bricks having dimensions of height, width and thickness, each brick of each partial ring having a sloping height and a median dimension of height different from each adjacent brick in said each partial ring.

7. A vessel according to claim 6 in which said interconnected refractory brick leveling assembly is located adjacent said bottom of said vessel.

8. A vessel according to claim 6 in which said all of said bricks of said partial rings are essentially identical in width and length.

9. A vessel according to claim 6 in which each partial ring is a semicircle.

10. A vessel according to claim 6 in which said first partial ring and said second partial ring are mirror images of each other.

11. A vessel according to claim 6 in which said first partial ring is a first semicircle and said second partial ring is a second semicircle, in which said semicircles each have a first end and a second end, and in which said first end of said first semicircle is in communication with said first end of said second semicircle and said second end of said first semicircle is in communication with said second end of said second semicircle to form one complete circle.

12. A vessel for containing high temperature molten metal, said vessel having a supporting shell with side walls and a sloping bottom to form an interior for containing said molten metal, said interior of said vessel including a lining of refractory bricks, an interconnected refractory brick leveling assembly comprising a first plurality of high temperature refractory bricks assembled into a first partial ring and a second plurality of high temperature refractory bricks assembled into a second partial ring, all of said bricks having dimensions of height, width and thickness, each brick of each partial ring having a sloping height and a median dimension of height different from each adjacent brick in said each partial ring, in which said first partial ring is a first semicircle and said second partial ring is a second semicircle, in which said semicircles each have a first end and a second end, and in which said first end of said first semicircle is in communication with said first end of said second semicircle and said second end of said first semicircle is in communication with said second end of said second semicircle to form one complete circle, and in which said heights of adjoining ends of bricks at adjoining ends of said first and said second semicircles are essentially identical.

13. A vessel for containing high temperature molten metal, said vessel having a supporting shell with side walls and a sloping bottom to form an interior for containing said molten metal, said interior of said vessel including a lining of refractory bricks, an interconnected refractory brick leveling assembly comprising a first plurality of high temperature refractory bricks assembled into a first partial ring and a second plurality of high temperature refractory bricks assembled into a second partial ring, all of said bricks having dimensions of height, width and thickness, each brick of each partial ring having a sloping height and a median dimension of height different from each adjacent brick in said each partial ring, further including at least one additional level of leveling refractory bricks overlying said first partial ring and said second partial ring to further compensate for said sloping bottom of said vessel.

14. A vessel according to claim 13 in which two courses of brick overlie one another for the principal part of a semicircle and for the remainder of said semicircle there is only a single layer.

15. A vessel according to claim 6 wherein said vessel is annular.

16. A vessel according to claim 6 wherein said vessel is essentially circular.

17. A vessel according to claim 6 in which adjoining bricks of each partial ring have an identical median dimension of length.

* * * * *